US005099759A

United States Patent [19]

Sonobe et al.

[11] Patent Number: 5,099,759

[45] Date of Patent: Mar. 31, 1992

[54] INK METERING ROLLER AND METHOD OF MANUFACTURING THE SAME

[75] Inventors: Saburo Sonobe, Toride; Nobuyuki Ishibashi, Matsudo, both of Japan

[73] Assignee: Kinyosha Co., Ltd., Tokyo, Japan

[21] Appl. No.: 408,486

[22] PCT Filed: Dec. 20, 1988

[86] PCT No.: PCT/JP88/01286

§ 371 Date: Aug. 14, 1989

§ 102(e) Date: Aug. 14, 1989

[87] PCT Pub. No.: WO89/05733

PCT Pub. Date: Jun. 29, 1989

[51] Int. Cl.[5] ..... B41F 31/00; B41F 5/24

[52] U.S. Cl. ..... 101/348; 29/121.8; 29/895.32

[58] Field of Search ..... 101/348, 349, 350; 29/121.1, 121.8, 132, 895, 895.3, 895.32

[56] References Cited

U.S. PATENT DOCUMENTS 2,804,678 9/1957 Rockoff ..... 101/348 X
2,863,175 12/1958 Meyer ..... 29/121.8
2,932,859 4/1960 Rockoff ..... 29/121.8
4,882,990 11/1989 Ijichi ..... 101/348
4,967,663 11/1990 Metcalf ..... 29/132 X

FOREIGN PATENT DOCUMENTS 62-71649 4/1987 Japan .
64-15517 1/1989 Japan .

*Primary Examiner*—Clifford D. Crowder

[57] ABSTRACT

According to the invention, a surface layer consisting of a synthetic resin or rubber substance which has an ink suction property and can be subjected to surface grinding is formed on the surface of a core metal, a large number of substantially spherical grains and a recess forming substance are mixed in the surface layer, a predetermined amount of substantially spherical grains are partially exposed on a surface region of the surface layer to form a large number of mutually independent projections, and a large number of recesses are exposed on the surface layer by the recess forming substance. There are provided a printing machine ink roller which can maintain transfer function of a predetermined amount of ink for a long time period, can improve printing performance of a printing machine, and can be easily manufactured and repaired and a method of manufacturing the same.

18 Claims, 2 Drawing Sheets

INK METERING ROLLER AND METHOD OF MANUFACTURING THE SAME

TECHNICAL FIELD

The present invention relates to a printing machine ink roller to be used as an ink receiving roller and an ink metering roller of an ink arrangement for, e.g., a flexographic printing machine, an offset printing machine, and a letterpress printing machine and a method of manufacturing the same.

BACKGROUND ART

In recent years, a keyless offset printing machine, which excludes an apparatus (ink adjusting buttons) for adjusting an ink amount in order to simplify a printing machine, has been increasingly used. This keyless offset printing machine has main purposes of simplifying a structure of a printing machine, decreasing a manufacturing cost, and allowing an unskilled operator to operate the machine. That is, conventional printing machines have a large number of ink adjusting buttons for adjusting an ink amount in the widthwise direction of an object to be printed. An ink amount required for printing is adjusting by periodically monitoring the object to be printed. The keyless offset printing machine will be described below with reference to FIG. 1.

Referring to FIG. 1, reference numerals 1 denote ink fountains which contain ink 2. Ink fountain rollers 4 are located above the ink fountains 1 to draw up the ink 2 from the ink fountains 1 and form ink films 3 on their surfaces. Metering rollers 5 are located above the ink fountain rollers 4 to receive the ink from the ink fountain rollers 4 and adjust metering. As the metering rollers 5, a roller called an anilox roller manufactured by forming a large number of independent small recesses (cells) for holding ink on the surface of a core metal (not shown) is generally used. A large number of independent pyramidal recesses 2*a* are formed on the surface of the anilox roller as shown in FIGS. 2(A) and 2(B), or a large number of pyramidal trapezoidal recesses 3*a* are formed thereon as shown in FIGS. 3(A) and 3(B). Doctor blades 6 made of steel (e.g., Sweden steel) are located in contact with the metering rollers 5 to scrape off excessive ink from the surfaces of the metering rollers 5. Rubber forme rollers 8 are located above the metering rollers 5 to supply the ink from the metering rollers 5 to forme cylinders. Rubber blanket cylinders 12 are located adjacent to the forme rollers 8 via forme cylinders 7 to transfer predetermined printing contents onto an object to be printed 13 such as paper. Dampening water 10 of dampening arrangements 9 is supplied to non-image areas of formes of the forme cylinders 7 via soaking rollers 11.

The surface layer of the metering roller 5 of the above keyless offset printing machine is molded as follows. That is, the surface of a steel roll (mother) having a large number of projections is urged against the surface of a core metal consisting of, e.g., iron, thereby forming the recesses 2*a* or 3*a* shown in FIG. 2 or 3, respectively. Chromium plating is then performed on the surface of the core metal. This chromium plating is performed to protect the surface of the core metal from abrasion caused by the doctor blade. The number of recesses 2*a* or 3*a* formed on the surface of the metering roller 5 serving as the anilox roller is represented by the number of recesses 2*a* or 3*a* arranged in a width of an inch. For example, "300 lines/inch" means that 300 recesses 2*a* or 3*a* are arranged in a width of an inch. The depth of each recess 2*a* or 3*a* is normally about 25 μm. In place of chromium plating, a ceramic such as tungsten carbite is sometimes flame-sprayed on the surface of the core metal.

Unlike the molding method of the recesses 2*a* or 3*a* using the mother, another molding method may be performed such that a ceramic is flame-sprayed on the surface of the core metal and then a laser beam is radiated thereon to form the recesses 2*a* or 3*a* on the surface of the core metal.

A roller for serving as the anilox roller of the keyless offset printing machine must satisfy the following conditions.

(1) Ink density is not reduced by dampening water, and roller stripping (a phenomenon in which ink cannot be spread on the roller due to dampening water) does not occur.

(2) The roller itself is not easily abraded, the shape of the recess (cell) is not changed, ink holding and supply are stably performed, and this state is maintained for about a year.

(3) The roller itself can be easily repaired.

(4) The shape or size of the recesses (cells) has no variation in a single roller or between rollers.

(5) An ink holding amount, i.e., ink density can be varied.

(2) The roller does not abrade a doctor blade.

The conventional roller used as the anilox roller, however, does not satisfy the above conditions and has the following drawbacks.

(1) Since copper, ceramic, or the like has no sufficient affinity with ink and does not have an ink suction property, density reduction or roller stripping often occurs due to ink holding property degradation caused by dampening water. When an alcohol is added in the dampening water, this phenomenon becomes more significant.

(2) Since the anilox roller made of a conventional material is easily abraded, the recesses (cells) are abraded, and ink density is reduced. Therefore, the conventional anilox roller must be replaced about every month.

(3) When a hard object hits the roller, the roller is scratched or cracked. Therefore, since the roller cannot be repaired, it must be remade.

(4) Since a force is physically applied to the anilox roller molded by urging a mother against a core metal, the shape of the recesses has large variations in a single roller and between rollers. For this reason, ink density variation occurs in printed objects.

(5) Since the pattern of the recesses is predetermined, ink density cannot be increased or decreased.

(6) Since a shoulder portion of the recess is sharp, a doctor blade is rapidly abraded by an anilox roller consisting of a super hard material and must be replaced with a new one after the use of about one week.

(7) In solid printed portion (a portion at which the entire printing surface is covered with ink), the pattern of the independent recesses is reproduced on a printed object.

(8) In order to mold the recesses by flame spraying or laser beam sculpture, an enormous installation cost is required.

(9) When color ink having a high ink tack is used, required ink density cannot be obtained because ink filling and holding properties are poor.

DISCLOSURE OF INVENTION

The present invention provides a printing machine ink roller which can maintain a transfer function of a predetermined amount of ink for a long time period, can increase printing performance of a printing machine, and can be easily manufactured and repaired and a method of manufacturing the same.

That is, the present invention is a printing machine ink roller comprising: a core metal; a surface layer which is formed on a surface of the core metal, has an ink suction property, can be subjected to surface grinding, and consists of a synthetic resin or a rubber substance; a large number of substantially spherical grains and a large number of small hollow spherical bodies mixed in the surface layer; a large number of mutually independent projections, partially exposed on a surface region of the surface layer, and formed of the substantially spherical grains; and a large number of substantially semispherical recesses, exposed on the surface region of the surface layer, and formed of parts of the small hollow spherical bodies.

As the synthetic resin, it is preferred to use any of an urethane resin, a polyamide resin, an epoxy resin, a vinyl chloride resin, a polyester resin, a phenol resin, a urea resin, a polyimide resin, a polyamide-imide resin, and a melamine resin. In order to adjust an ink suction property on the surface layer, two or more types of these resins having different ink affinities may be arbitrarily used.

As the rubber substance, it is preferred to use any of nitrile rubber, urethane rubber, chloroprene rubber, acryl rubber, epichlorohydrin rubber, chlorosulfonated polyethylene, chlorinated polyethylene, fluorine rubber, ethylene propylene rubber, polybutadiene rubber, natural rubber, and polysulfide rubber. In order to adjust the ink suction property on the surface layer, two or more types of these rubber substances having different ink affinities may be arbitrarily used.

The synthetic resin and the rubber substance have slight ink permeability. The ink affinity on the surface layer is increased by this ink permeability. As a result, the ink suction property is imparted to the surface layer. Therefore, even when dampening water becomes excessive upon operation of the printing machine, problems such as stripping are significantly reduced, and stable printing is assured.

The ink suction property is for not only pure printing ink but also for so-called emulsion ink containing dampening water. It is assumed that 10% to 20% of dampening water are normally contained in ink. Therefore, a conventional concept that the anilox roller must be lipophilic and especially hydrophobic is not included in the present invention. This is because an anilox roller consisting of a material having these properties selectively accepts only ink but repels dampening water, thereby promoting separation of the ink from the dampening water to cause roller stripping. As a result, various printing failures occur.

On the contrary, the printing machine ink roller according to the present invention consisting of the rubber substance or synthetic resin and the substantially spherical grains and the recesses has a better wetting property with dampening water than that of the conventional anilox roller. For this reason, the affinity with emulsion ink is good, an ink resin property is good, and ink transfer is smoothly performed, thereby assuring stable printing.

When the synthetic resins and the rubber substances of the above types were observed by a microscope after they had been used as, e.g., a rubber roller for a year, ink permeability of about 1 mm was found. The type of synthetic resin or rubber substance must be determined in accordance with the type of ink to be printed. If a substance having excessive ink permeability is used, an outer appearance of the surface layer is undesirably changed. In addition, the hardness of the surface layer is preferably set to be 80 or more by Shore hardness A. This is because if the hardness is less than 80, the surface layer is strongly abraded by a doctor blade.

As the substantially spherical grain, it is preferred to use at least one of a spherical silica grain, a spherical alumina grain, a spherical aluminosilicate grain, a spherical ceramic grain, a spherical glass grain, a spherical stainless steel grain, a spherical epoxy resin grain, and a spherical phenol resin grain. The type of grain to be used is preferably determined in consideration of the affinity with the above synthetic resin or rubber substance and a grinding property. In general, it is preferred to use the substantially spherical grain consisting of silica or alumina manufactured by a high-temperature flame spraying method.

The grain must be substantially spherical for the following reason.

That is, the substantially spherical shape is required in order to prevent abrasion of a doctor blade in contact with the printing machine ink roller and to prevent abrasion of the printing machine ink roller itself. If not a spherical grain but an irregular alundum or corundum grain is used, not only the doctor blade is abraded, but also other rollers in contact with the printing machine roller are scratched. In addition, the spherical grain can suppress heat generation upon contact with another roller.

Since the spherical grains have good flowability or filling property upon molding, they can be processed very easily. Therefore, a large amount of spherical grains can be filled. This is an important factor especially when a base material is a liquid. If grains are irregular, dispersion becomes nonuniform, and therefore a large amount of grains cannot be filled. In addition, since a resistance is high upon mixing, heat is generated, a pot life is shortened, and hardening is started before or during casting. Therefore, especially a large roll cannot be manufactured. When the surface is abraded by a whetstone or the like after hardening, the whetstone itself is abraded if the grains are irregular. As a result, constant surface roughness cannot be obtained, and roller diameter precision becomes poor.

By the use of spherical grains, all the above problems are solved, and the printing machine ink roller can be easily manufactured.

The substantially spherical grains are made harder than the synthetic resin and the rubber substance for the following reason. That is, this is because after the printing machine ink roller is manufactured, the substantially spherical grains can be exposed from a surface region (ink suction layer) 17 without being ground by only grinding a base material layer 18, thereby easily forming projections independently from each other (see FIGS. 4 and 5). As a result, an ink suction layer 17 can be easily formed on the projections 16 and a flat region of the base material layer 18. In addition, since the substantially spherical grains are hard, high shape precision of the ink suction layer can be maintained for a long time period.

Another feature of the present invention is that an ink holding portion is positively formed. That is, a conventional anilox roller consists of cells having the same pyramidal or trapezoidal pyramidal pattern. In order to obtain precise printing reproducibility, the number of lines must be increased. In this case, the size and depth of each cell are decreased. As a result, an ink holding amount is decreased, and necessary ink density cannot be obtained. Especially in color printing, since tacks of indigo blue ink, red ink, and yellow ink are higher than that of an Indian ink, filling and holding properties of the ink with respect to the cells are very important. In the conventional anilox roller having independent cells, since the ink holding and filling properties are poor with the same number of lines as that for the Indian ink, the number of lines must be decreased. As a result, the cell patterns are reproduced on a printed object to significantly degrade its clearness.

In order to solve this problem, the present invention comprises mutually independent substantially spherical grains, a surface layer having an ink suction property, and a recess forming substance, located in the surface layer, for forming recesses, wherein ink holding portions consisting of the recesses are positively formed to largely increase an ink holding amount, thereby assuring sufficient ink density.

In a void forming method for forming the recesses, for example, a water- or solvent-soluble substance is mixed in the base material together with the substantially spherical grains and a hardening agent, uniformly dispersed, and then hardened or crosslinked, and a surface layer is ground. Thereafter, the soluble substance is eluted and removed from the surface layer by water or a solvent, thereby forming the recesses. Examples of the water-soluble substance are powders of sodium chloride, sugar, starch, salt cake, potassium carbonate, potassium nitrate, calcium nitrate, ammonium nitrate, sodium nitrate, zinc chloride, zinc nitrate, urea, barium chloride, polyvinyl alcohol, C.M.C. (caroboxymethylcellulose), gum arabic, gelatin, polyacrylic soda, polyethyleneoxide, and methylcellulose. The size of voids can be determined by milling and classifying grains by a jet mill, a ball mill, or the like and mixing grains having a desired size. The ratio of voids can be determined by changing a mixing amount of the water- or solvent-soluble substance in the base material.

In another method, small hollow spherical bodies are mixed and uniformly dispersed in the base material together with the substantially spherical grains and the hardening agent, and then hardened or crosslinked, and a surface layer is ground. As a result, a part of a shell constituting the small hollow spherical body is removed to form the recess. Examples of the small hollow spherical body are those having shells consisting of a vinylidene chloride resin, an epoxy resin, a phenol resin, a nylon resin, alumina, silica, aluminosilicate, glass, and ceramic. The same effect can be obtained by, e.g., Silas balloon.

In still another method, a metal powder of, e.g., zinc' iron' aluminum, tin, or magnesium is mixed and uniformly dispersed in the base material together with the substantially spherical grains, and then hardened and crosslinked, and a surface layer is ground by a whetstone or the like. Thereafter, voids are formed by an acid such as hydrochloric acid or sulphuric acid or alkali reduction using caustic soda (NaOH) and sufficiently washed with water to form the recesses. Types of the metal powder, acid, and alkali are not limited to those enumerated above.

The voids can also be formed by mixing a substantially spherical grain hardening agent in the base material, and mixing air, nitrogen gas, carbonic acid gas, or the like under pressure, and then reducing the pressure.

In still another method, an organic or inorganic blowing agent is mixed in the base material together with a substantially spherical hardening agent, and heated to a temperature higher than a decomposition point of the blowing agent to produce nitrogen gas, carbonic acid gas, or the like, thereby forming the voids. Examples of the blowing agent are azobis, isobutylonitrile, toluenesulfonylhydrazide, p-p'oxybisbenzenesulfonylhydrazide, dinitropentamethylenetetramine, azodicarbonamide, ammonium carbonate, and sodium bicarbonate. In this case, it is preferred to select a blowing agent having a decomposition point lower than a hardening temperature of the base material. If a blowing agent having a decomposition point higher than the hardening temperature of the base material is used, sufficient voids cannot be formed.

In still another method, a porous substance, e.g., urethane foam, cork, sponge rubber, or impregnated paper is milled, mixed in the base material together with the substantially spherical grain hardening agent, and sufficiently dispersed and hardened, and a surface layer is ground, thereby forming the voids.

The shapes of voids differ in the respective methods. For example, the shape is semispherical in the small hollow spherical body and the blowing agent or air mixing method, and it is irregular in the powder eluation/dissolution method or porous substance mixing method. The type of method is arbitrarily selected in accordance with the type, color, and tack of ink and quality, e.g., density of a printed material.

The size of formed voids is 5 to 100 μm. Preferably, the size is 20 to 80 μm.

In the methods in which the water-, solvent-, and acid/alkali-soluble substances are mixed, hardened, and ground to form the voids, the mixing substance may consist of 5- to 100-μm diameter grains. A powder having a necessary size can be obtained by classifying a milled powder obtained by a mill such as a ball mill, a jet mill, or the like or an atomized powder obtained by an atomizer.

In the method of forming the voids by the small hollow spherical bodies, grains having a grain size of 5 to 100 μm may be selected.

In the organic or inorganic blowing agent or air mixing method, the size of voids depends on a mixing amount with respect to the base material, a pressure, a temperature, and the like. The mixing amount of the blowing agent with respect to 100 part of the base material is preferably 1 to 10 parts by weight. The size of voids, however, changes in accordance with the pressure of the hardening temperature.

In the present invention, sandblasting or the like is performed for a core metal to remove rust, and an adhesive is applied after degreasing using, e.g., trichloroethane. The core metal is then placed at the center of a cylinder having an inner diameter larger than the thickness in the specification of the printing machine by about 5 mm.

The substantially spherical grains according to the present invention, the hardening agent, and the recess forming substance serving as an ink holding portion according to the present invention are sufficiently mixed in the base material layer having an ink suction property according to the present invention, thereby preparing a mixture which is degased if necessary. Additives such as a dispersion accelerator, an aging inhibitor, an ink suction accelerator, a filler, a coloring agent, and an adhesive can be added to the resultant mixture if necessary.

The mixture is injected in the cylinder and heated to accelerate hardening of the base material. A heating temperature is determined in accordance with the type of base material. After the mixture is hardened and cooled, it is extracted from the cylinder and ground to have a predetermined thickness (outer diameter) by a whetstone. When the voids are already formed, the printing machine ink roller having a three-layered surface structure comprising mutually independent projections formed by the substantially spherical grains, the continuous surface layer having an ink suction property, and the recesses for holding ink formed in the surface layer is manufactured.

When the voids are not formed yet after grinding, e.g., when the voids are to be formed by the water-soluble substance, the resultant structure is submerged in water or hot water to form the voids and then dried, thereby manufacturing the printing machine ink roller having the three-layered surface structure.

The printing machine ink roller according to the present invention comprises the continuous surface layer (base material) having the ink suction property, the ink holding recesses having an arbitrary size in the surface layer, and the mutually independent projections consisting of the substantially spherical grains. Therefore, as compared with the conventional anilox roller consisting of a metal or ceramic, an ink holding property is improved, an ink holding amount is increased, and abrasion of the roller is reduced because friction with a doctor blade is reduced. As a result, a degree of freedom of ink blending is increased, the quality of a printed material is improved, problems caused by dampening water is solved, a printing efficiency is increased, and a long service life of the printing machine ink roller is assured.

If the surface of the printing machine ink roller is scratched by mistake, the surface an be easily repaired to recover its original state by grinding using a whetstone or the like.

For this reason, in the case of the keyless offset printing machine shown in FIG. 1, for example, the printing machine ink roller is mounted at a position denoted by each reference numeral 5 and serves as an ink receiving/metering roller. Excessive ink on a surface layer 17 and the ink holding portions (denoted by reference numeral 19 in FIGS. 4 and 5) of the printing machine ink roller is scraped off by each doctor blade 6 and transferred onto a corresponding forme roller 8. The ink is transferred at a position at which nips of the printing machine ink roller and the forme roller are separated from each other. Since the ink on the surface layer (denoted by reference numeral 17 in FIGS. 4 and 5) and in the ink holding portions continues, a so-called vacuum effect does not occur unlike in the conventional anilox roller. As a result, ink transfer can be efficiently and easily performed.

In addition, since the tops of the mutually independent substantially spherical grains and the doctor blade are in point-contact with each other to scrape the ink, a frictional resistance is small, and an abrasion or heat generation amount is very small. Therefore, a change in ink characteristics, e.g., ink Cook value is small even after long-time printing to assure stable printing.

According to the present invention, since the recesses for holding ink are positively formed in the surface layer (base material) having the ink suction property, a larger amount of ink than in the conventional anilox roller can be held. Therefore, an ink amount for an object to be printed is increased increase the density. Especially in color printing, a problem of low density posed by the conventional anilox roller is solved by the printing machine ink roller of the present invention. The number or size of the recesses can be arbitrarily changed. Therefore, a selection range is widened. In addition, since the surface layer (base material) has the ink suction property, the printing machine ink roller according to the present invention has strong affinity with emulsion ink, and therefore no roller stripping occurs.

The present invention is also a method of manufacturing a printing machine ink roller in which a surface layer having a large number of projections and recesses on a surface region thereof is formed on a circumferential surface of a core metal, comprising the steps of: mixing a base material consisting of a synthetic resin or rubber substance having an ink suction property and a large number of substantially spherical grains and a recess forming substance having a higher hardness than that of the base material; hardening or crosslinking a mixture obtained in the mixing step to form a surface layer element consisting of the base material, the recess forming substance, and the substantially spherical grains; grinding the surface layer element to partially expose an arbitrary number of the large number of substantially spherical grains 16 on the surface region to form a large number of mutually independent projections, and exposing a large number of substantially semi-spherical recesses 19 by the recess forming substance, thereby forming a surface layer.

As a means for coating the surface layer on the surface of the core metal, casting, rotational molding, a sheet forming technique, reaction injection molding (RIM), flame spraying, and the like can be adopted.

The casting method can be adopted when the base material is a liquid. In this method, the base material, the substantially spherical grains, the recess forming substance, and the hardening agent are mixed and degased to prepare a mixture for forming the surface layer. The core metal having an adhesive coated on its surface is set in a die. The above mixture is cast and hardened in this die, thereby forming the surface layer integrally with the core metal. Thereafter, the surface layer is subjected to grinding and recess forming processing if necessary, thereby obtaining the printing machine ink roller.

In the rotational molding method, a rotational molding cylindrical die is prepared. Inner surface grinding is performed for a cavity portion of the die, and a lubricant is coated thereon. A mixture prepared following the same procedures as in the casting method is injected in the cavity. Thereafter, rotational molding is performed at a predetermined temperature for a predetermined time interval to harden the mixture, thereby forming the surface layer. The obtained surface layer is removed from the die, and its inner surface is ground. Thereafter, a predetermined core metal is inserted in the surface layer by, e.g., shrink fit. The surface layer is then subjected to grinding and recess forming processing if necessary, thereby manufacturing the printing machine ink roller.

The sheet forming technique can be adapted when the base material is solid and is of a kneading type. In this method, the substantially spherical grains, the recess forming substance, a crosslinking agent, and necessary chemicals such as processing assistants are mixed to form a sheet. The sheet is wound around a predetermined core metal. The wound sheet is then subjected to a heat treatment to form the surface layer integrally with the core metal. Thereafter, the surface layer is subjected to grinding and processing of forming recesses in the base material if necessary, thereby manufacturing the printing machine ink roller. In this case, the surface layer to be wound around the core metal can be formed by extrusion molding.

In the above methods, grinding is performed using a whetstone or grinding cloth.

The types of synthetic resin, rubber substance, substantially spherical grain, the shape of substantially spherical grain, and the type and shape of recess forming substance are the same as described above.

A mixing amount of the substantially spherical grains to be mixed in the base material is 10 to 400 parts by weight with respect to 100 parts by weight of the base material. If the mixing amount is less than 10 parts by weight, a level difference between the projections and the surface layer becomes insufficient. If the mixing amount exceeds 400 parts by weight, the number of projections becomes excessive to degrade the ink holding property.

BRIEF DESCRIPTION OF DRAWINGS

FIGS. 2A, 2B, 3A 2 and 3B are views for explaining recesses formed on the circumferential surface of an anilox roller;

BEST MODE FOR CARRYING OUT THE INVENTION

Figure 1:
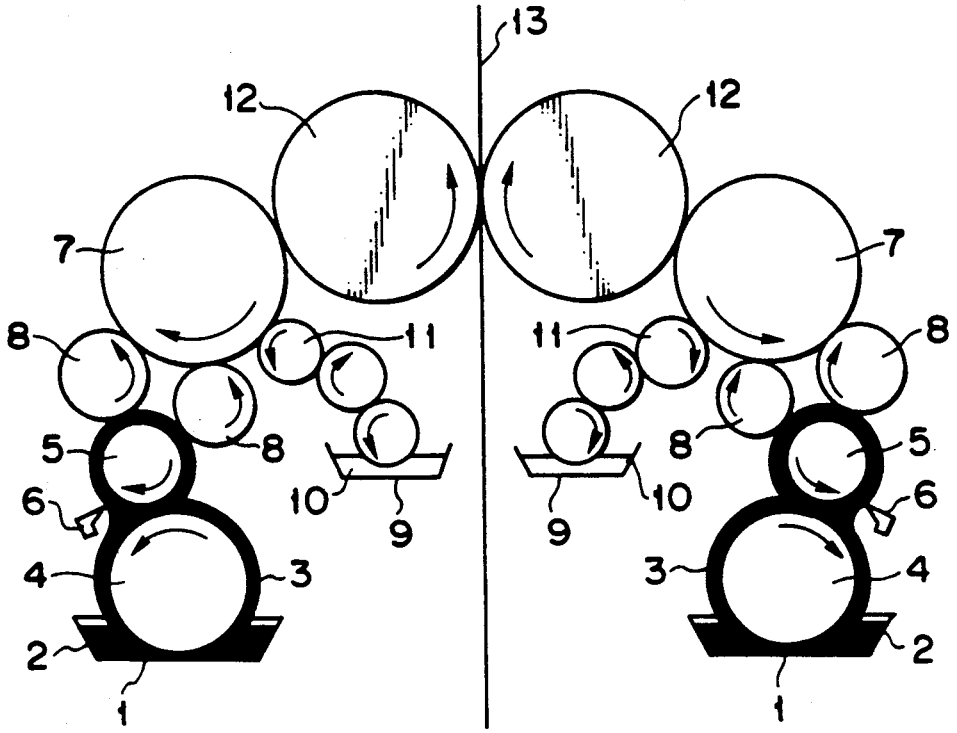
FIG. 1 is a schematic view showing an arrangement of a keyless offset printing machine.
Figure 2A:
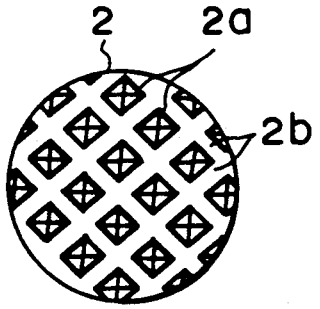
Figure 2B:
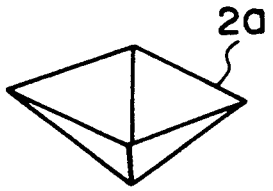
Figure 3A:
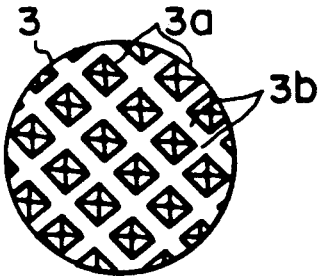
Figure 3B:
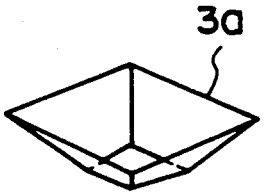
Figure 4:
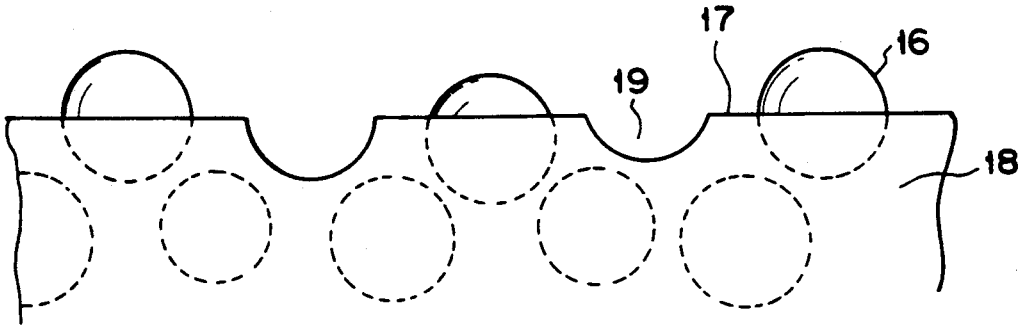
FIG. 4 is a sectional view showing a main part of an embodiment of the present invention.
Figure 5:
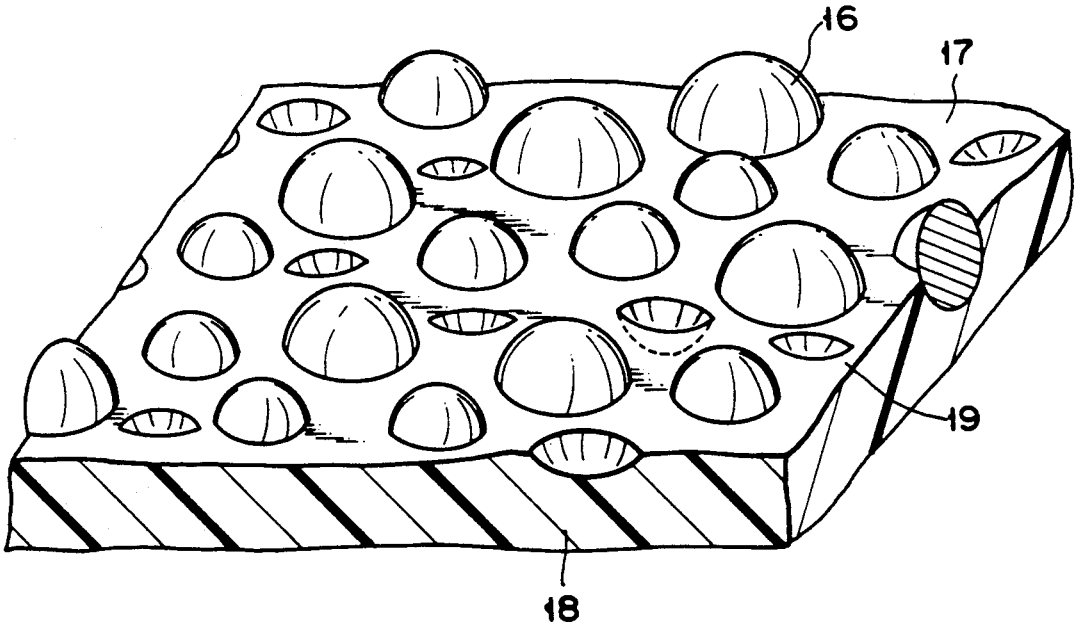
FIG. 5 is a perspective view showing a main part of the embodiment of the present invention.

The present invention will be described in detail below by way of its examples.

EXAMPLE 1

100 parts by weight of SANNIX HR-450P (polyol available from SANYO CHEMICAL INDUSTRIES, LTD.) were heated and dehydrated, and 150 parts by weight of hard spherical grains S-COH (available from Micron Co.) consisting of silica having an average grain size of 35 μm and 25 parts by weight of small hollow spherical bodies (available from Sumitomo Three M Co.) having an average grain size of 50 μm were mixed thereto by a mixer. 110 parts by weight of MILLIONATE MT (isocyanate available from Nippon Polyurethane K.K.) were added as a hardening agent to the resultant material and sufficiently stirred at reduced pressure, thereby preparing a material for forming a surface layer.

A core metal obtained by performing rust removal and degreasing and then coating an adhesive on its surface was formed into a die, and the material prepared as described above was injected in this die and heated and hardened at 85° C. for six hours, thereby forming a surface layer on the surface of the core metal.

Thereafter, the resultant structure was removed from the die, and surface grinding was performed for the surface layer by using a whetstone, thereby forming a surface layer having an outer diameter of 175 mm and a half thickness of 5 mm.

The surface roughness (Rz) (10-point average roughness) of the printing machine roller manufactured as described above was 20 μm and its Shore hardness was 86°. The printing machine roller was mounted at a position of an anilox roller of a keyless offset printing machine and used as an ink metering/receiving roller. The roller was used six hours a day at a rotational speed of 400 r.p.m. for six months. During this operation period, no roller stripping occurred, and a doctor blade was replaced only once. In addition, the roller surface was not changed at all. Densities at a solid portion of a printed material were measured by using X-Rite 408. As a result, the densities of Indian ink, indigo blue ink, red ink, and yellow ink were 1.15, 0.94, 0.98, and 0.80, respectively, i.e., sufficient densities were obtained for printed contents. The densities were not changed after six months have passed.

On the contrary, when the conventional anilox roller was used under the same conditions, ink density reduction was started after about one month has passed. At this time, the densities of Indian ink, indigo blue ink, red ink, and yellow ink were 0.95, 0.84, 0.88, and 0.75, respectively. When the roller surface was observed, the cell depth was decreased, and the surface roughness (Rz) which was initially 26 μm was 17 μm. In addition, abrasion of doctor blades was 2 mm and the doctor blade had to be replaced three times.

EXAMPLE 2

100 parts by weight of epoxy resin Araldite AY105 (Japan Ciba Geigy Co.) and 20 parts by weight of hardening agent HY956 (Japan Ciba Geigy Co.) were mixed. 180 parts by weight of hard spherical grains Alunabeads CB-A60 (available from Showa Denko K.K.) consisting of alumina having an average grain size of 60 μm and 20 parts by weight of Filite 300/7 (aluminosilicate available from Filite Co.) as small hollow spherical grains having an average grain size of 45 μm were added and sufficiently mixed in the resultant mixture.

A core metal obtained by performing degreasing and sandblasting and then coating an adhesive on its surface was formed into a die, and the material prepared as described above was injected in the die and hardened in a room whose temperature was adjusted at about 50° C. for 24 hours, thereby forming a surface layer on the surface of the core metal.

Thereafter, the resultant structure was removed from the die, and the surface layer was ground by a whetstone, thereby manufacturing a printing machine ink roller having an outer diameter of 175 mm and a half thickness of 5 mm.

The 10-point average roughness (Rz) of the surface of the printing machine ink roller manufactured as described above was 27 μm, and its Shore D hardness was 85. This printing machine ink roller was mounted at a position of an anilox roller of a keyless offset printing machine and used as an ink metering/receiving roller. The roller was used seven hours a day at a rotational speed of 450 r.p.m. to perform printing for one year. During this operation period, roller stripping caused by dampening water did not occur at all. The density of the Indian ink measured by X-Rite 408 was very stable between 1.1 to 1.15. The 10-point average roughness of the surface of the printing machine ink roller after printing was 24 to 26 μm, i.e., a change was very small. In addition, the outer diameter was 176 mm within the measurement error and had almost no change. A doctor blade was replaced three times during this year.

After the operation period of one year, a scratch having a depth of 0.5 mm and a width of 30 mm was formed on the surface of the printing machine ink roller by mistake. Therefore, a material was prepared as described above, flowed and hardened in the scratch, and ground by a whetstone. Thereafter, the ink roller was mounted on the machine again and printing could be performed without any trouble.

Example 3

| Mixing Composition | Parts by Weight |
|---|---|
| JSRN230S (nitrile rubber available from Japan Synthetic Rubber Co., Ltd.) | 100 |
| Zinc Oxide | 5 |
| Sulfur Powder | 40 |
| Accelerator CZ | 1 |
| Accelerator D | 1 |
| Stearic Acid | 1 |
| Aging Inhibitor | 1 |
| Clay | 50 |
| Sumilight Resin PR310 (phenol resin available from Sumitomo Durez Inc.) | 30 |
| Nipol1312 (liquid nitrile rubber available from Nippon Zeon Co., Ltd,) | 10 |
| Alunabeads CB-A30 (hard spherical alumina beads having an average grain size of 30 μm available from Showa Denko K.K.) | 150 |
| Salt Cake (average grain size = 60 μm) | 100 |
| | 489 |

The above mixture was sufficiently kneaded by mill rolls. The resultant material was formed into a 2-mm thick sheet by using calendar rolls.

A core metal provided in addition to the above mixture was subjected to sandblasting. A rubber cement prepared by dissolving the above mixture in toluol was coated on the surface of the core metal. The sheet formed as described above was wound around the core metal coated with the rubber cement to have a diameter of 180 mm.

Thereafter, a cotton tape and a steel wire were wound around the circumferential surface of the wound surface layer. The resultant structure was put into a vulcanizer and heated and vulcanized at a steam pressure of 4 kg/cm$^2$ for six hours.

After the resultant structure was cooled, the surface layer was ground by a whetstone to have a diameter of 175 mm and then using sandpaper of 240#. Thereafter, the resultant structure was submerged in a water tank whose temperature was adjusted to be 80° to 90° C. for 24 hours to elute the salt cake in the surface layer of the roller, thereby manufacturing the printing ink roller comprising independent substantially spherical grains, the surface layer having an ink suction property, and recesses for holding ink. The Shore D hardness of the surface layer was 90°, and its surface roughness (Rz) was 30 μm.

The printing machine roller manufactured as described above was mounted in place of a conventional anilox roller of a keyless offset printing machine and used as an ink metering/receiving roller. The roller was used six hours a day at a rotational speed of 400 r.p.m. for one year. The density of Indian Ink measured by X-Rite 408 was initially 1.1 to 1.15 and sufficient. When this ink was used as a spot color with red ink, the density was 1.0 and sufficient.

During this operation period, a doctor blade was replaced three times. Roller stripping did not occur.

After the roller was used for another year, the diameter was increased to be 176 mm, and the surface was scratched. Therefore, the roller was removed from the printing machine, ground again, submerged in a water tank at 80° to 90° C. for 24 hours, and then dried. As a result, the scratched roller was repaired as an entirely new printing machine ink roller which could be used again.

Industrial Applicability

The present invention can maintain a transfer function of a predetermined amount of ink for a long time period, can improve printing performance of a printing machine, can be easily manufactured and repaired, and is very effective as an ink receiving roller of an inking arrangement for, e.g., a flexographic printing machine, an offset printing machine, and a letter press printing machine.

We claim:

1. A printing machine ink roller comprising: a core metal and an ink absorbable surface layer which is formed on a surface of said core metal, the surface layer: comprising a mixture of a base material, a plurality of substantially spherical grains and a plurality of small hollow spherical bodies; wherein a plurality of mutually independent projections are partially exposed on a surface region of said surface layer, and formed by said substantially spherical grains; and further wherein a plurality of substantially semispherical recesses are exposed on said surface region of said surface layer, and formed by parts of said small hollow spherical bodies.

2. A roller according to claim 1, wherein said base material comprises a synthetic resin selected from the group consisting of urethane resin, polyamide resin, epoxy resin, vinyl chloride resin, polyester resin, phenol resin, urea resin, polyimide resin, polyamide-imide resin, and melamine resin.

3. A roller according to claim 1, wherein said base material comprises a rubber selected from the group consisting of nitrile rubber, urethane rubber, chloroprene rubber, acryl rubber, epichlorohydrin rubber, chlorosulfonated polyethylene, chlorinated polyethylene, fluorine rubber, ethylenepropylene rubber, polybutadiene rubber, polysulfide rubber, and natural rubber.

4. A roller according to claim 1, wherein said substantially spherical grains consist of at least one of spherical silica grains, spherical alumina grains, spherical aluminosilicate grains, spherical ceramic grains, spherical titania grains, spherical chrome oxide grains, spherical zirconia grains, spherical tungsten carbite grains, spherical silicon carbite grains, spherical heins alloy grains, spherical satellite alloy grains, heistellite alloy grains, delchromium alloy grains, spherical glass grains, spherical stainless steel grains, spherical epoxy resin grains, and spherical phenol resin grains.

5. A roller according to claim 1, wherein a diameter of said substantially spherical grains is 5 to 100 μm, and preferably, 10 to 60 μm.

6. A roller according to claim 1, wherein said small hollow spherical bodies have an outer shell consisting of at least one of a vinylidene chloride resin, an epoxy resin, a phenol resin, a nylon resin, alumina' silica, aluminosilicate, glass, and ceramic.

7. A roller according to claim 1, wherein a diameter of said small hollow spherical bodies is 5 to 100 μm, and preferably, 20 to 80 μm.

8. A method of manufacturing a printing machine ink roller in which a surface layer having a plurality of projections and recesses on a surface region thereof is formed on a circumferential surface of a core metal, comprising the steps of: mixing an ink absorbable base material, a large number of substantially spherical grains, and a means for forming the plurality of recesses, said grains having a higher hardness than that of said base material; hardening or crosslinking a mixture obtained in said mixing step; grinding said surface layer to partially expose at least some of said plurality of substantially spherical grains on said surface region to form a large number of mutually independent projections; and exposing a large number of substantially semispherical recesses provided by said means, thereby forming said surface layer.

9. A method according to claim 8, wherein a mixing amount of said substantially spherical grains to be mixed in said base material is 10 to 400 parts by weight with respect to 100 parts by weight of said base material.

10. A method according to claim 8, wherein said means for forming the plurality of recesses includes small hollow spherical bodies, and exposure of said recesses is achieved during the grinding step.

11. A method according to claim 8, wherein said means for forming the plurality of recesses includes any one of a water-soluble substance, an organic solvent-soluble substance, a substance soluble in an acidic or alkaline chemical, an organic or inorganic blowing agent, and a porous substance.

12. A method according to claim 11, wherein said water-soluble substance consists of at least one of a sodium chloride powder, a sugar powder, a starch powder, a salt cake powder ($Na_2SO_4$), a potassium carbonate ($K_2CO_3$) powder, a potassium nitrate ($K_2NO_3$) powder, a calcium nitrate ($Ca(NO_3)_2$), an ammonium nitrate ($NH_4NO_3$) powder, sodium nitrate ($NaNO_3$), zinc chloride ($ZnCl_2$), zinc nitrate ($Zn(NO_3)_2$), a urea powder, barium chloride ($BaCl_2$), a polyvinylalcohol powder, a carboxymethylcellulose powder, gum arabic, gelatin, polyacrylic soda, polyethyleneoxide, and methylcellulose.

13. A method according to claim 11, wherein said means for forming the plurality of recesses includes a gas which is any one of air, carbonic acid gas, and nitrogen gas.

14. A method according to claim 11, wherein said substance soluble in an acidic or alkaline chemical is any one of iron, aluminum, tin, zinc, and magnesium, the acid is hydrochloric acid or sulfuric acid, and the alkali is sodium peroxide.

15. A method according to claim 11, wherein said organic or inorganic blowing agent is at least one of azobisisobutylnitrile, toluenesulfonylhyrazide, p-p'oxybisbenzenesulfonylhydrazide, dinitrosopentamethylenetetramine, azodicarbonamide, sodium bicarbonate, and ammonium bicarbonate.

16. A method according to claim 11, wherein said porous substance is any one of a cork powder, an urethane foam powder, a sponge rubber powder, and an impregnated paper powder.

17. A method according to claim 11, wherein an addition amount of said water-soluble substance and said substance soluble in an acidic or alkaline chemical to said base material is 10 to 400 parts by weight with respect to 100 parts by weight of said base material.

18. A method according to claim 11, wherein a grain size of said water-soluble substance and said substance soluble in an acidic or alkaline chemical is 5 to 100 μm.

* * * * *

UNITED STATES PATENT AND TRADEMARK OFFICE

CERTIFICATE OF CORRECTION

PATENT NO. : 5,099,759

DATED : March 31, 1992

INVENTOR(S) : SONOBE et al.

It is certified that error appears in the above-identified patent and that said Letters Patent is hereby corrected as shown below:

On the cover sheet of the patent, the priority claim based on PCT/JP87/01001 filed in Japan on December 21, 1987 should be indicated.

Signed and Sealed this

Tenth Day of August, 1993

*Attest:*

Michael K. Kirk

MICHAEL K. KIRK

*Attesting Officer*

*Acting Commissioner of Patents and Trademarks*